United States Patent [19]

Wrennall

[11] Patent Number: 4,572,376

[45] Date of Patent: Feb. 25, 1986

[54] DIAL PILL BOX

[76] Inventor: Richard K. Wrennall, 74 Cromer Rd., Victoria 3193, Beaumaris, Australia

[21] Appl. No.: 615,742

[22] Filed: May 31, 1984

Related U.S. Application Data

[63] Continuation-in-part of Ser. No. 418,990, Sep. 16, 1982, abandoned.

[51] Int. Cl.[4] ..... B65D 83/04

[52] U.S. Cl. ..... 206/538; 206/534; 220/253

[58] Field of Search ..... 206/533, 534, 538, 405, 206/539, 532; 220/253; 215/219, 220, 216, 201, 330, 337, 329

[56] References Cited

U.S. PATENT DOCUMENTS

| | | | |
|---|---|---|---|
| 2,953,242 | 9/1960 | Shaw | 206/534 |
| 3,143,207 | 8/1964 | Wagner | 206/533 |
| 3,469,681 | 9/1969 | Norman, Jr. | 206/405 |
| 3,537,422 | 11/1970 | Moe | 206/534 |
| 3,895,730 | 7/1975 | Koehne et al. | 215/216 |
| 4,011,829 | 3/1977 | Wachsmann et al. | 206/534 X |
| 4,099,639 | 7/1978 | Boxer et al. | 215/216 X |
| 4,164,301 | 8/1979 | Thayer | 206/534 X |
| 4,245,742 | 1/1981 | Rossmo | 206/534 |
| 4,364,484 | 12/1982 | Kinsley | 215/220 |

*Primary Examiner*—Allan N. Shoap

*Assistant Examiner*—Bryon Gehman

*Attorney, Agent, or Firm*—Depaoli & O'Brien

[57] ABSTRACT

A dial pill box comprises a container having 28 arcuate storage compartments for pills and the like, a pair of lids, and a central pivot pin which pivotably holds together the container and the lids. The pivot pin enables the containers to be assembled by snapping the lids onto the container and over the pivot pin and to be disassembled by pinching together the resiliently bifurcated ends of the pivot pin and pushing these ends toward the lids and through their central holes. After removing both lids, a user can fill the container with a week's supply of pills, capsules, tablets, and the like of pharmaceuticals, vitamins, and/or minerals. He can spin the upper lid independently of the lower lid in one direction, so that none of the four segment apertures in the upper lid coincide with the access sector of the lower lid, whereby the dial pill box is in position for storage and transportation. By spinning both lids together in the opposite direction, the user can place the access sector in the lower lid over a selected storage sector, having four storage compartments, which is marked for the desired day of the week. By then spinning the upper lid again in the first direction, he can spirally place a selected segment aperture, corresponding to the selected time of day, over the access sector and then remove the pills therefrom.

6 Claims, 10 Drawing Figures

DIAL PILL BOX

CROSS REFERENCE TO A RELATED APPLICATION

This application is a continuation in part of Ser. No. 06,418,990, filed Sept. 16, 1982, now abandoned entitled "Pillbox".

BACKGROUND OF THE INVENTION

1. Field of the Invention

This invention relates to dispensers for medication such as capsules and pills. It particularly relates to multi-compartmented dispensers for storing and selectively dispensing at least one pill at a plurality of intervals during a succession of days.

2. Description of the Prior Art

Many containers for storing and dispensing pharmaceutical preparations, vitamins, and minerals in pill, tablet, and capsule form are available. Some, such as blister packs, are not refillable. Others are divided into compartments which are separately accessible and are, for example, openable and closeable by a thin, slide-out lid. Such lids can slide out completely or can snap off; in addition, both the pills and the lids can be lost. Still further, their effectiveness is often dependent upon multi-colored compartments and components. For people with poor vision or no vision and for people with poor color perception, particularly elderly people with little strength in their hands and fingers or with arthritis, a more easily and dependably manipulated device is needed. In addition, storage of a considerable supply of pills and the like is desirable because elderly and handicapped persons may require assistance in loading a pill box, and such assistance may not be available on a daily basis.

As an example of an existing device, U.S. Pat. No. 2,953,242 describes a pill container having a projecting circular base from which a plurality of upstanding concentric flanges and 12 radial flanges project upwardly, thereby providing 24 individual compartments in two circular series. A central area has a central hole for insertion of a pivot pin which is also coaxially inserted through two overlapped cover members, each cover member having a rotation-facilitating tab. One cover member has a pair of openings which are angularly separated by 180°, and the other cover member has a pair of openings which are angularly displaced by less than 180°. In addition, the openings in each cover member are regularly displaced from each other so that it is always impossible for more than two openings to be simultaneously aligned.

U.S. Pat. No. 3,469,681 describes a tape reel container having a pair of plastic body portions interconnected by a separate mechanical lever and sliding and tilting internal lock members cammed to move radially, inwardly, and outwardly to obtain a very strong and positive lock action in order to avoid the major disadvantage of prior devices, i.e., accidental unlocking or releasing. Its non-unitary, resilient prong is concealed behind a closed container and is inaccessible for immediate opening and closure action by external finger pressure of a user.

U.S. Pat. No. 3,744,672 relates to a pill dispenser which includes an upper, inner, annular tier and a lower, outer, annular tier. Each tier contains a plurality of regularly extending and arcuately spaced, pie-shaped, pill dispensing compartments. A centrally disposed cylindrical opening extends into the center portion of the dispenser for storage of a pill bottle. As seen in FIGS. 2 and 3, the hours of the day are printed on the doughnut-shaped disk and are visible through the dial covers and the base unit.

U.S. Pat. No. 4,011,829 is directed to a tamper-proof container having a visual indicating means of advancing one number for each time the container is opened or closed. It comprises a combination of four members which are essentially a container and three separately rotatable members mounted thereon. The screw top is provided with a skirt which surrounds one member and includes a central longitudinal projection having a boss which is force-fitted through a hole in the indexing member. This indexing member is a rotatable disc having numbers engraved on its upper face and wedge-shaped projections on its upper and lower faces for engagement with a wedge-shaped projection on the upper surface of the one member with a wedge-shaped projection on the lower surface of the other member. The numbers on the indexing member shows the number of tablets dispensed. None of these members is mutually removeable during usage. The face member can only be removed from the container threaded tab by manually holding down a tooth and twisting in an anti-clockwise direction. The removal and replacement of the rotory members is made as difficult as possible in a tamper-proof or child-proof design. The single, upwardly directed tooth on the container is not fixed but is removable by hand for freeing the lid.

U.S. Pat. No. 4,164,301 discloses a multi-compartmented container having two superposed lids, each lid having a single aperture of corresponding shape. Separate safety locking and unlocking arrangements between the lids rely upon the pressing and releasing of top tabs or buttons by an operator. Great stress is laid on locking and unlocking arrangements between the lids, wherein 1) a press tab on the upper disk has to be pushed down against the ridge on an upwardly projecting bar of the lower disk which disengages a bar on the lower disk and 2) a button has to be pressed to disengage the locked together and the superposed plates. More importantly, the covers are not locked in any particular circumferential position. There is no counter-rotational indexing or control means.

U.S. Pat. No. 4,245,742 relates to a medication dispenser which comprises a container member, a first indexing member which is coaxially mounted on the container and rotatable therein, and a second indexing member which is coaxially mounted on top of the first indexing member. The container has a base portion and a tubular central hub with a plurality of partitions extending radially outwardly therefrom to divide the container into seven compartments. Additional radial partitions, intermediate partitions, and an annular partition sub-divide the compartments into smaller compartments. The first indexing member is in the form of a shallow cylinder having a continuous sidewall and a top wall. The sidewall has a series of notches therein, each notch being positioned opposite the center of one of the seven compartments when the first indexing member is placed over the container and is adapted to be engaged by a detent on a locking device. The top wall of the first indexing member has an elongated pie-shaped opening which falls into registry with a selected compartment of the seven compartments when the first indexing member is rotated. The second indexing member is in the form of a circular disk having four segment-shaped apertures, each of which corresponds to one of the subcompartments. The second indexing member is provided with a series of circumferentially spaced detents which are releasably engaged by corresponding protuberances provided in the upper terminal edge of the first indexing member.

U.S. Pat. No. 4,320,834 relates to a latch assembly for a reel container. Specifically, its body has a central, upright post with a mushroom-shaped head at its end. The cover comprises a concentric inner dish-shaped wall into which a latch assembly, including a handle, fits. A latching member also fits within the wall and slideably engages the latch assembly and the head. It comprises a contact surface, which is disposed normal to the top surface of the cover, a hook-like projection, and a U-shaped spring. When the body, cover, the latch assembly, and the latching member are properly assembled, axial pressure apparently causes the projection to engage the head. When sideward pressure is exerted against the surface, thereby compressing the spring, the projection is slid sidewardly and freed from the head so that the cover can be removed from the body.

U.S. Pat. No. 4,379,914 describes a pilfer-resistant container having means to indicate to the consumer that the contents have not been tampered with. It is normally inaccessible for continual usage and re-usage because the construction prevents access to contents until a non-replaceable tab has been removed from an access opening. The central, resiliently pronged hub is disposed from the bottom of the body for snapfitting the body and the lid together.

It is apparent that these pill dispensing devices of the prior art do not expose each dosage compartment separately and individually with separate indexing of longer and shorter dosage time interval compartments. Further, they provide no means for making the successive compartments instantly accessible.

SUMMARY OF THE INVENTION

It is accordingly an object of this invention to provide a pill box having means for storing and dispensing an entire week's supply of pills and the like.

Is is also an object to provide a pill box having a pair of lids and means for selecting a day's supply of pills and the like without the need for a separate locking device, by rotation of at least one lid in one direction and for selecting an individual dosage by rotation of at least one lid in the other direction.

It is further an object to provide a pill box having means for locating both a day's supply and an individual dosage when illumination is poor or non-existent or when the user is blind.

It is additionally an object to provide a pill box having means for grasping and manipulating that are within the capabilities of persons with arthritis and of elderly people having little strength in their hands and fingers.

In accordance with these objects and the principles of this invention, a dial pill box is provided that comprises a wide, shallow, circular container having a central hole and a plurality of arcuate storage compartments, a pair of lids with central holes, and a pivot pin which fits within the holes and rotatably holds container and lids together. The lids are a lower lid and an upper lid. The lower lid comprises a central hole, a pie-shaped access sector, and a peripheral dependant skirt. The upper lid comprises a central hole, a plurality of segment apertures which are spaced apart both circumferentially and radially, and a notched periphery.

The 28 storage compartments in the container are formed by seven radial walls and by three circular walls between the outer wall and the central hole, whereby seven storage sectors, each containing four arcuate storage spaces, are defined. The successive radial distances between the circular walls increases with nearness to the central hole so that storage areas are somewhat equalized.

The perimeter wall is stepped to provide a perimeter shelf at about one half its height. The bottom edge of the dependent skirt of the lower lid rests upon and slides over this shelf.

A ratchet-and-pawl device, which is disposed on this skirt and shelf, provide an interlocking means for these components of the dial pill box which allows the lower lid to be rotated in one direction only with respect to the container. The ratchet tooth, if disposed on the shelf, is located at a peripheral position opposite one of the radial walls and, if disposed on the lower lid along the bottom perimeter of the circular cover or on the bottom edge of the dependent skirt, is located so that the radial edges of the open sector in the lower lid coincide with the radial walls of the container.

Another ratchet-and-pawl device is disposed on the top periphery of the lower lid and the bottom periphery of the upper lid as an interlocking means which allows these components of the dial pill box to be rotated together in the first direction and the upper lid to be rotated by itself in the opposite direction. Its ratchet tooth and six indentations are disposed so that, when interlocked, the radial edges of its segment apertures coincide with the radial edges of the open sector of the lower lid and with two of the radial walls of the container.

The dial pill box is characterized by ready accessibility of its storage compartments to a user who is blind or in darkness, selectivity of any storage compartment by two twirling motions of its lids in opposite directions to provide access circumferentially in one direction to a selected day's supply and then spirally in the other direction to a desired dosage, quick releasability of its component parts to permit its container to be loaded at one time with an entire week's supply of pills and the like, quick assembly of its components, and capability of being manipulated by an elderly person with weak or arthritic hands and fingers.

Quick releasability of its components is provided by pinching the protruding parts of the cam portion of the resiliently bifurcated pivot pin while pushing the pin toward and through the upper lid. By removing both lids, the container is immediately available for loading with a week's supply of pills and the like. By coaxially placing both lids over the container and thrusting the pivot pin into the bottom of its central hole and then through the central holes of both lids until the bifurcated ends snap into locked position, the dial pill box is assembled and instantly available for storage and access.

The relatively large diameter and shallow depth of the dial pill enable it to be easily grasped; moreover, its large radius provides high torque to an elderly or infirm person who is attempting to twirl its lids and thereby furnishes a high degree of manipulative capability. In addition to its torque characteristics, the dial pill box is shallow and wide in order to provide storage space for an entire week and instant accessibility to any selected compartment. The diameter of the dial pill box is suitably six to ten times, and preferably eight times, its depth.

The pair of ratchet-and-pawl devices are disposed along the peripheries of the wide, shallow container and its pair of lids in order to maximize the stability of the lids. The ratchet-and-pawl devices, each having a single ramped ratchet tooth and a plurality of indentations, form cooperating rotational control and stop means that provide access circumferentially to a day's supply and then radially (more realistically, spirally) to a selected dosage.

A person who needs a dosage during periods of darkness or who is blind can readily manipulate the dial pill box by: (1) locating the desired day, as indicated by a Braille symbol along the bottom beneath each daily storage compartment of the container, with a fingertip, (2) sliding the fingertip outwardly and then upwardly over the outer perimeter wall and in position to feel the dependent skirt of the lower lid, (3) rotating both lids until the leading edge of the raised "TODAY" marking on the dependent skirt is felt by the fingertip and continuing the rotation slightly until the lower lid is locked in place for the selected day of the week by the lower ratchet-and-pawl device, (4) while grasping the container with the thumb and fingers on one hand, placing a fingertip of the other hand within the segment aperture of the upper lid that corresponds to the desired daily dosage, (5) rotating the upper lid in the other direction, while the fingertip slides over the surface of the cover of the lower lid, until the sliding fingertip within the segment aperture pushes into the corresponding storage compartment and the upper lid is locked in place by the upper ratchet-and-pawl device, and (6) inverting the dial pill box over a cupped hand or other receptacle to obtain the stored dosage.

For a person on regular medication it is not absolutely necessary to commence the weeks sequence on the correct day. As soon as one day's dosages are retrieved, the next day follows by rotating the lids clockwise 1/7 turn.

BRIEF DESCRIPTIONS OF THE DRAWINGS

The dial pill box may be more readily understood by reference to the following drawings in which like reference numbers designate corresponding parts.

FIG. 1 is a plan view of the container having a central hole filled with a bifurcated pivot pin and 28 storage compartments wells separated by seven radially aligned dividing walls and three circular walls, in which pills and the like are stored.

FIG. 2 a plan view of the lower lid, having a central hole and an open sector with arcuate bars thereacross.

DESCRIPTION OF THE PREFERRED EMBODIMENTS

Figure 1:
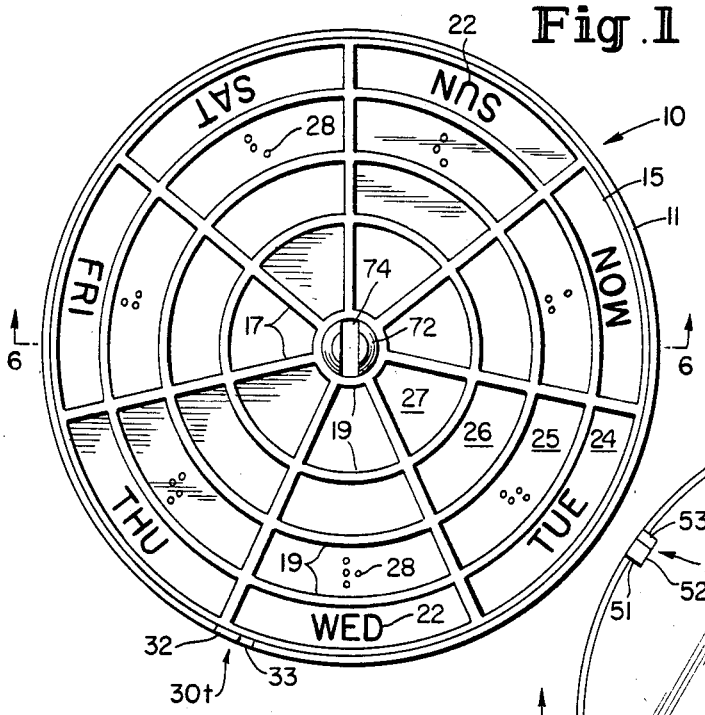

The dial pill box of this invention comprises a container 10, a lower lid 40, an upper lid 60, and a central pivot pin 70 which may be molded as an integral portion of container 10, be glued thereto by the user, if desired, or be used as a separate component of the pill box, as shown in the drawings.

All components 10, 40, 60, 70 are preferably manufactured by molding from a transparent synthetic plastic material, such as polymethyl methacrylate, polystyrene, polybutylacrylate, and nylon, or mixtures thereof, having substantial rigidity but sufficient flexibility for snap fitting and camming movements. Pivot pin 70 is of resilient split-pin construction and is adapted to receive and hold container 10 and lids 40, 60 together while serving as a central pin around which the pair of lids can be rotated as desired.

The two interlocking means are disposed on container 10 and lids 40, 60 in oppositely facing relationship to provide counter-rotational movement and stop control. These means are a lower ratchet-and-pawl device 30 and an upper ratchet-and-pawl device 50.

Figure 4:
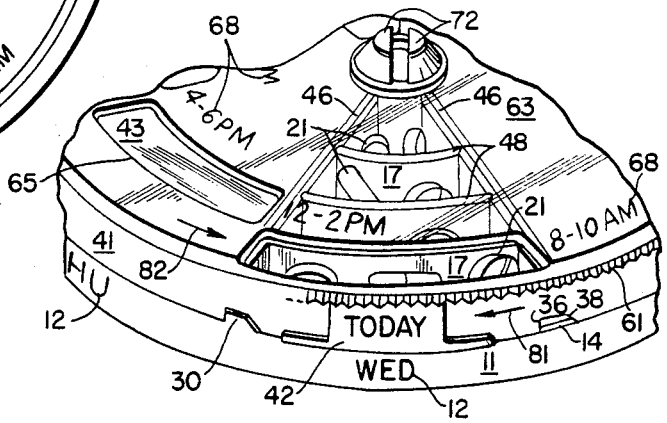
FIG. 4 is a partial top perspective view of the assembled and filled dial pill box, having its lids positioned to furnish access to the outermost access opening which is suitably utilized for the earliest dosage time of the day.

As shown in the drawings, container 10 comprises a bottom 13, an outer perimeter wall 11, a perimeter shelf 14, and a stepped-back perimeter wall 15 which coincides with the interior of wall 11. Container 10 further comprises seven radial walls 17 and four circular walls 19 within perimeter wall 11. Walls 11, 17, 19 form a plurality of arcuate storage compartments 24, 25, 26, 27 within each pie-shaped sector between each pair of radial walls 17. Near the central intersection of radial wall 17 is a central hole 29 which is formed by the innermost circular wall. On the bottom surface of bottom 13 are letters 22 indicating each day of the week in abreviation and raised dots 28 in groups which indicate the same days of the week in Braille. In addition, as seen in FIG. 4 and also at the bottom of FIG. 5, letters 12 along wall 11 indicate the days of the week for each pie-shaped sector outlined by each pair of adjacent radial walls 17.

Figure 2:
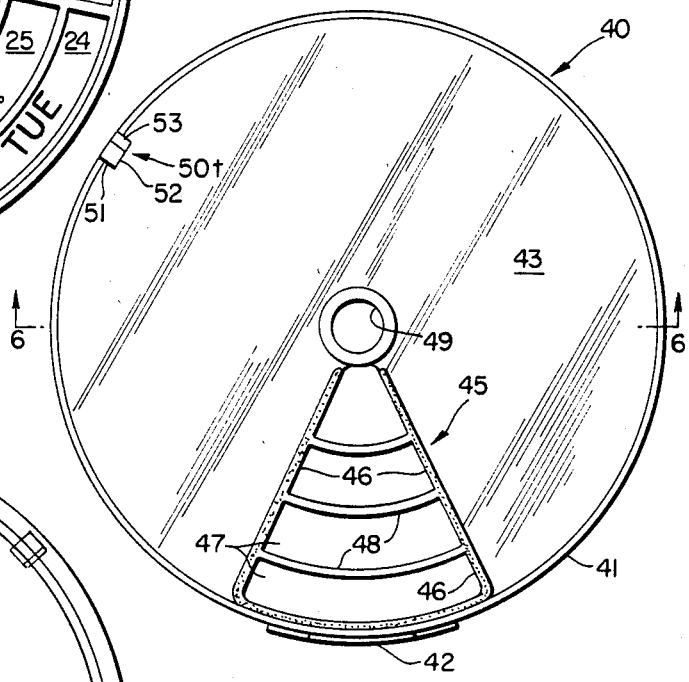
Figure 3:
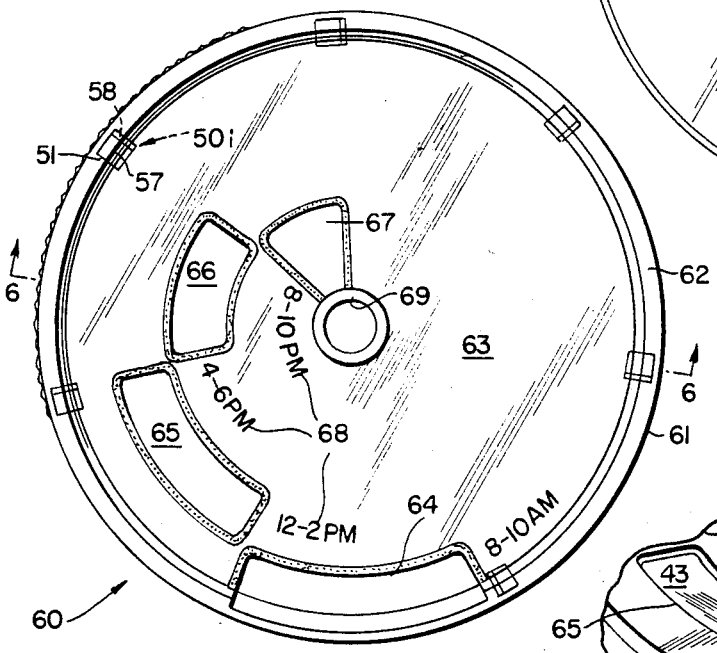
FIG. 3 is a plan view of the top lid having a central hole and four access openings which are aligned with four contiguous sectors and are successively closer to the center hole when observed in clockwise direction.
Figure 5:
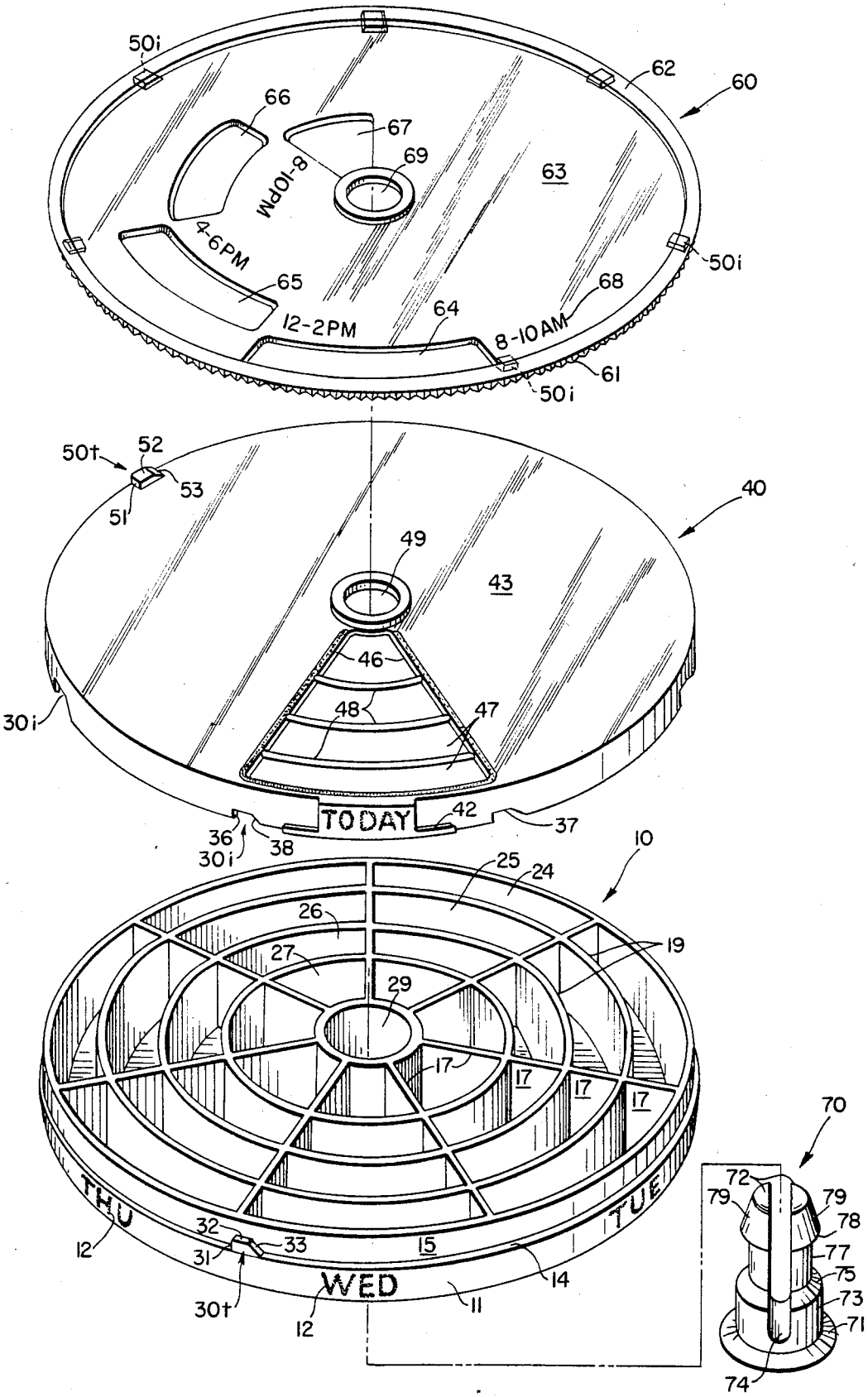
FIG. 5 is an exploded top perspective view of the entire dial pill box, while empty, so that the relationship of its components is readily understood.

Lower lid 40, as shown clearly in FIGS. 2 and 5, comprises a depending skirt 41, a flat surface 43, an open pie-shaped sector 45, and a central hole 49. Sector 45 equals 1/7th of the entire area of surface 43. Sector 45 comprises radial sides 46, annular bars 48 joining sides 46, and arcuate open spaces 47 which are bounded by sides 46 and bars 48. On perpendicular outer skirt 41 and in radial alignment with sector 45 is a raised portion 42 bearing the word "TODAY".

Interlocking means 30 is disposed along the periphery of container 10 and lower lid 40 and allows lower lid 40 to be rotated in one direction only with respect to container 10. Interlocking means 30 comprises a ratchet tooth 30*t*, which is disposed on shelf 14, and seven pawl indentations 30*i* which are disposed in the lower edge of skirt 41 and are spaced apart by 1/7th of the circumference thereof. Two indentations 30*i* are radially aligned with sides 46 of sector 45. Ratchet tooth 30*t* is radially aligned with one radial wall 17.

Ratchet tooth 30*t* comprises an axially aligned side 31 which is normal to shelf 14, a slide surface 32 which is parallel thereto, and a cam surface or ramp 33 which slopingly connects surface 32 to shelf 14. Pawl indentations 30*i* each comprise a side 36 which is substantially equal in height to side 31 and normal to flat surface 43, a straight side 37 which is substantially equal in length to slide surface 32 and also parallel to surface 43, and a cam surface 38 or ramp which is parallel to cam surface 33 when container 10 and lid 40 are juxtaposed.

Ratchet tooth 30*t* and pawl indentations 30*i* can alternatively be disposed on the top edge of stepped-back perimeter wall 15 and on the bottom of circular cam 43.

Upper lid 60 comprises a continuous array of notches 61 in its outer perimeter, a raised outer wall 62, a flat circular cover 63, four arcuate segment apertures 64, 65, 66, 67, timed dosage indicia 68, and a central hole 69. Apertures 64, 65, 66, 67 are spaced apart both angularly and radially, have an arcuate width equalling 1/7th of the circumference (approximately 51.5°), and radial widths equalling the distances between annular bars 48 of lid 40. Hole 69 is surrounded by a circular raised bead at its upper end and by a circular depression at its lower end.

Interlocking means 50 for lower lid 40 and upper lid 60 is disposed slightly inwardly of their peripheries and allows upper lid 60 to be rotated in one direction only with respect to lower lid 40, this direction being opposite to the rotational direction for interlocking means 30. Interlocking means 50 comprises six pawl indentations 50*i*, which are disposed in the lower surface of raised outer wall 62 and spaced apart by 1/7th of the circumference thereof, and a single ratchet tooth 50*t* which is disposed close to the periphery of lid 40, in upstanding relationship to surface 43, and in radial alignment with one of the indentations 30*i*.

Ratchet tooth 50*t* and pawl indentations 50*i* are similar in construction to tooth 30*t* and indentations 30*i* and include respective axially aligned surfaces 51, 56, respective rotationally aligned surfaces 52, 57, and respective ramps 53, 58.

Figure 6:
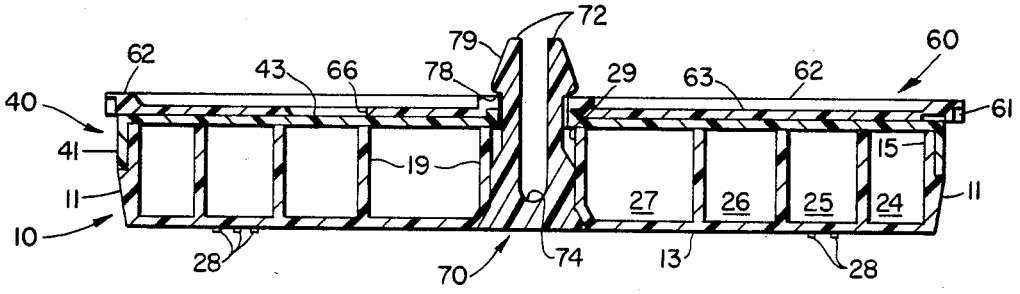
FIG. 6 is a sectional elevational view, taken in the direction of the arrows 6—6 in FIGS. 1, 2, and 3, of the assembled dial pill box.
Figure 7:
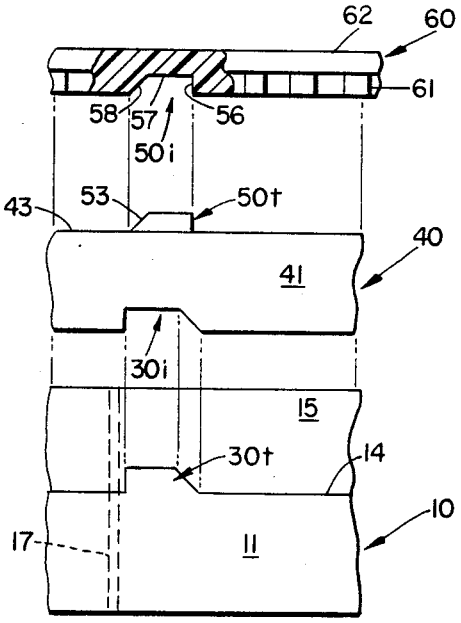
FIG. 7 is an elevational exploded view of a portion of the assembled dial pill box, with a portion of the top lid broken away beyond the ratchet tooth of the upper interlocking means, so that the lower interlocking means is shown in alignment with the ratchet tooth of the upper interlocking means.
Figure 8:
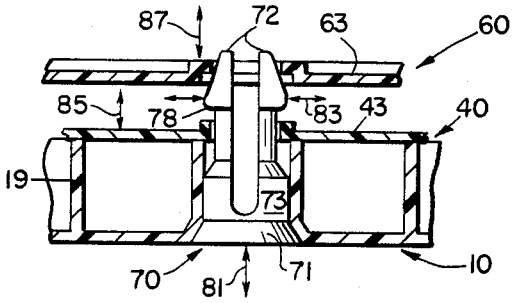
FIG. 8 is a partial sectional elevational view, similar to FIG. 6, in which the pivot pin is not sectioned, the lower lid is in position, and the upper lid is being lowered onto, or lifted from, the lower lid. Directions of movements of the bifurcated parts of the pivot pin, the lower lid, and the upper lid, during assembly or disassembly of the dial pill box, are shown.

As shown in FIG. 5, pivot pin 70 comprises a beveled base 71, a lower cylindrical portion 73, a sloping annular shoulder 75, an upper cylindrical portion 77, a circular shoulder 78, and a cam portion 79. However, a deep, axially aligned recess, having bottom 74 deep within cylindrical portion 73, bifurcates pin 70 into two parts 72. Referring to FIG. 8, parts 72 are resiliently compressible along vectors 83 as lower lid 40 and upper lid 60 are successively pressed downwardly, as indicated by vectors 87. Parts 72 move outwardly again when each lid 40, 60 is pushed past cam portions 79, thereby locking lids 40, 60 into pivotable contact with container 10 between base 71 and shoulder 78, as shown in FIG. 6.

Again referring to FIG. 8, the dial pill box is quickly dissembled by pinching parts 72 together and simultaneously pushing them toward lid 60. Pin 70 immediately and rapidly slides through central holes 69, 49, 29 and out of contact with container 10; lids 40, 60 and container 10 thereupon are immediately separable.

Container 10 is then easily filled with up to 28 portions of medications, vitamins, minerals, and the like in tablet, pill, and/or capsule form, enough to supply a user for an entire week at four dosages/day. After replacing lids 40, 60 onto container 10 so that sector 45 and segment apertures 64, 65, 66, 67 do not coincide and then snapping pivot pin 70 into place with one hand through central holes 29, 49, 69 while compressing bottom 13 and lid cover 63 between a thumb and forefinger of the other hand, the dial pill box is ready for storage or for transporting in any position. Alternatively, the dial pill box is available for instant access.

Figure 10:
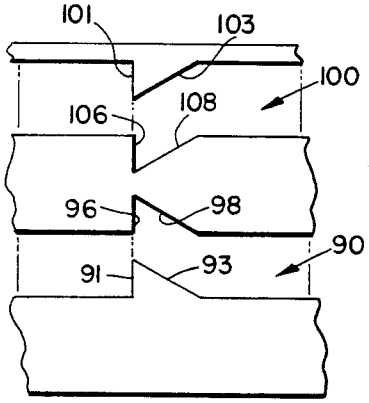
FIG. 10 is a partial elevational view, similar to FIG. 7, of another embodiment of the lower and the upper interlocking means.
Figure 9:
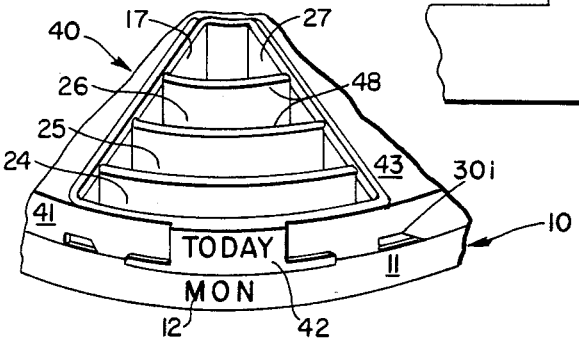
FIG. 9 is a partial top perspective view, similar to FIG. 4, of the empty container and the lower lid with its access sector.

An alternative interlocking means is shown in FIG. 10 in which ramped ratchet teeth and complementary-shaped pawl slots are entirely on the periphery of the dial pill box and with the teeth in facing relationship. Lower interlocking means 90 comprises a tooth on the shelf of the container, having an axially aligned side 91 and a ramp 93, and a plurality of pawl slots in the bottom edge of the skirt of the lower lid, each slot having an axially aligned side 96 and a ramp 98. Upper interlocking means 100 comprises a tooth on the periphery of the upper lid, having an axially aligned side 101 and a ramp 103, and a plurality of pawl slots along the periphery of the top of the lower lid, each having an axially aligned side 106 and a ramp 108.

The dial pill box is assembled by inserting pivot pin 70 into the bottom of central hole 29 of container 10 until base 71 fits into a similarly beveled recess in bottom 13 and cylindrical portion 73 is in rotatable contact with the lower part of surface 29, with the upper part of cylindrical portion 77 and cam portion 79 protruding beyond container 10. While container 10 and pivot 70 are resting, for example, on a hard surface, lower lid 40 is pushed onto container 10, as indicated by vectors 85, while parts 72 are thereby resiliently squeezed together along vectors 83 until lid 40 is beyond cam portion 79. Then upper lid 60 is pushed downwardly toward lid 40, as indicated by vectors 87, while parts 72 are thereby again squeezed together until lid 60 also is past cam portion 79, whereupon both lids 40, 60 are snugly secured in rotatable contact with container 10.

The filled box is operated by clasping upper lid 60 along notches 61 with one hand and base 10 with the other hand, and by rotating lids 40, 60 simultaneously in clockwise direction 81 until "TODAY" on raised portion 42 is in the middle of the desired day of the week and is consequently above and closely adjacent to the selected day indicia 12. Next, upper lid 60 is rotated in counter clockwise direction 82, while lower lid 40 remains immovable because it is secured by ratchet and pawl arrangement 30, until the desired dosage time coincides with pie-shaped open sector 45.

When an arcuate storage compartment has been emptied, the remainder of the dial pill box is closed. Further counter clockwise rotation opens up the next storage compartment at the time needed. When all of that day's dosages are removed, one further stop closes the evening storage compartment. Both lids 40, 60 are then turned clockwise to index pie-shaped sector 45 over the storage sector for next day. At the next time for removing pills, such as "12–2 PM", upper lid 60 is further rotated counter clockwise in direction 82 until the segment aperture 65 for 12–2 PM is within pie-shaped sector 45 on lower lid 40.

An important characteristic of the dial pill box is that it is shallow but relatively wide in diameter. Suitably, its diameter is about eight times its width. Because this width and the notched periphery provide high torque, it is consequently feasible for a user to grasp upper lid 60 along notches 61 with a thumb and a forefinger which are approximately 135°–180° apart or with all digits of one hand, while grasping sides 11 of container 10 with the other hand, and to twirl lids 60, 40 with little difficulty.

Even a user afflicted with arthritis can grasp and rotate the dial pill box in this manner. If his sight is additionally poor or non-existent, or if illumination is poor, he can hear and feel lid 40 successively engage each ratchet and interlocking means 30, corresponding to successive days of the week, as he twirls both lids 40, 60 clockwise in direction 81. He then can notice a different sound as he twirls lid 60 counter clockwise in direction 82, while successively engaging ratchet and interlocking means 50, past each day of the week in opposite succession.

It is not really necessary, however, to be able to identify the days of the week, provided that lower lid 40 is only turned one notch at a time at the end of each day.

A user can also visually locate pie-shaped sector 45, which preferably possesses a distinctive color along the upper edges of radial sides 46 and along the upper edge of its outer skirt 41 that connects sides 46, and can identify the "TODAY" marking on raised portion 42. If illumination or eyesight are deficient, however, he can locate raised portion 42 with his fingertips so that motion in direction 81 can be stopped at marks 22, 28 corresponding to the desired day.

The upper edges of each segment aperture 64, 65, 66, 67 in lid 60 are marked with a bright color which is sharply distinguishable from the color surrounding sector 45 in lid 40. A user can utilize the location of these colored outlines and/or timed indicia 68 to align the desired opening with sector 45. If eyesight or illumination are poor, however, he can rest one fingertip within any dial opening 64, 65, 66, 67 and slide it over cover 43, while rotating lid 60 in direction 81, until it rides over one raised edge 46 and then drops into a storage compartment 24, 25, 26, 27.

What is claimed is:

1. An oral, solid dosage form, pharmaceutical dispenser comprising: a flat, circular container with a transparent walled base having a plurality of arcuate storage compartments arranged within main radial sector storage compartments formed by radial walls and a peripheral wall, all of the arcuate circular segment, storage compartments being formed by sub-dividing the radial walls by annular walls: a lower circular lid and an upper circular lid superposed over the lower lid, each lid having a central hole, the lower lid having a peripheral skirt and a single radial sector storage compartment access opening corresponding in shape and dimension to each main radial sector storage compartment, the upper lid having a plurality of radially and circumferentially spaced arcuate circular segment compartment-access openings corresponding in shape to each respective arcuate circular segment compartment, the peripheral skirt of said lower lid encompassing a portion of the exterior of said peripheral wall of the base; a resilient bifurcated pivot pin for detachably and rotatably clamping the lids onto the container and for removal of the lids from the container to recharge the container with dosages; lower interlocking means comprising means on the exterior of the peripheral wall and fixed with respect to the base for interlocking with complementary shaped means on the lower edge of the peripheral skirt of, and fixed with respect to, the lower lid and rotating only when the said lid is rotated, upper interlocking means comprising means on the upper surface of, and fixed with respect to, the lower lid interlocking with complementary shaped means on the lower surface of the upper lid, and fixed with respect to the upper lid and rotated with the upper lid, all of said interlocking means cooperating when the lids are rotated by hand for controlling the rotational direction of the lids with respect to each other and the base and providing dosage interval click stops whereby all compartments may be covered and radial sector storage compartments and arcuate segment storage compartments selectively and successively uncovered and dosage dispensed from the compartments through lid openings, said lower interlocking means allowing said lower lid to be rotated in one direction only with respect to said container and said upper interlocking means allowing said upper lid and said lower lid to be rotated together in said one direction and said upper lid to be rotated by itself in the opposite direction, to close all compartments or selectively open compartments whereby rotation of both said lids in said one direction enables said radial sector compartment access opening of said lower lid to be located above and aligned with one selected radial sector storage compartment of said container and rotation of said upper lid in said other direction enables one of said arcuate access openings to be located above and aligned with one of said correspondingly shaped arcuate storage compartments of said container.

2. The pharmaceutical dispenser according to claim 1, wherein the upper lid has four openings therein, each opening corresponding in area to a respective arcuate segment compartment and being spaced radially successively in a series of immediately adjacent openings, each at a distance equal to the radial width of each adjoining arcuate sector compartment and spaced angularly, successively, at a distance corresponding to the angular length of the said respective sector compartment which said opening overlies, each said arcuate segment compartment being sequentially uncovered by four successive angular movements of the said upper lid in the same rotational direction.

3. The pharmaceutical dispenser according to claim 2, wherein the exterior surface of the stepped container peripheral wall has a single fixed ramped ratchet tooth projecting upwardly therefrom, the edge of the skirt of the lower lid has seven equidistantly spaced ratchet indentations, each correspondingly in shape to, and successively engaging with the tooth of the container wall, the upper surface of the lower lid has a single fixed ramped tooth projecting upwardly therefrom, adjacent the perimeter thereof, the upper lid has six indentations moulded in the lower surface and adjacent the periphery thereof, the indentations being equidistantly spaced at a circumferential distance equal to a seventh radial segment arc and of corresponding shape to the lower lid fixed ratchet tooth.

4. The pharmaceutical dispenser according to claim 3, wherein the ramped or uni-directional notches of the upper lid are moulded into the lower surface thereof, aligned with the direction of rotation of the said lid and spaced at angular positions around the lid at the same distance subtended by each sector, said notches being disposed vertically and directly above a radial wall of a sector compartment of the container when the lids are in the open access position upon the container and being equal in angular distance to the wall arc of a segment compartment, a single, uni-directional ramped tooth being fixedly moulded on the upper surface of the lower lid also being aligned with the direction of rotation of the said lid and being positioned over a radial wall of a sector compartment of the container, whereby when the upper lid is rotated in its uni-direction, each ramped notch thereof sequentially and selectively engages the single ramped tooth of the lower lid to align a respective arcuate segment access opening of the upper lid over the access opening of the lower lid and only over a single respective arcuate segment compartment.

5. An oral, solid dosage form, pharmaceutical dispenser comprising: a flat, circular container with a transparent walled base having a plurality of arcuate storage compartments arranged within main radial sector storage compartments formed by radial walls and a peripheral wall with a stepped exterior surface, all of the arcuate circular segment storage compartments being formed by sub-dividing the radial walls by annular walls, a lower circular lid and an upper circular lid superposed over the lower lid, each lid having a central hole, the lower lid having a peripheral skirt and a single radial sector storage compartment access opening corresponding in shape and dimension to each main radial sector storage compartment, the upper lid having a plurality of radially and circumferentially spaced arcuate circular segment compartment-access openings corresponding in shape to each respective arcuate circular segment compartment; a resilient bifurcated pivot pin detachably passable through the central hole of both lids and accessible to finger manipulation from outside the lids and the container for rotatably and resiliently clamping the lids onto the container and for removal of the lids from the container to recharge the container with dosages; lower interlocking means comprising a single fixed ramped tooth projecting upwardly from the stepped exterior surface of the peripheral wall of the container and fixed with respect thereto for interlocking successively with seven complementary shaped means comprising ratchet indentations on the lower edge of the peripheral skirt of, and fixed with respect to, the lower lid and rotating only when the said lower lid is rotated, upper interlocking means comprising a single fixed ramped tooth projecting upwardly from the upper surface of, and fixed with respect to the lower lid adjacent the perimeter thereof, interlocking with complementary shaped means on the lower surface and fixed with respect to the upper lid and comprising six equidistantly spaced indentations of complementary shape to the single ramped tooth on the lower lid and rotating with the upper lid and at a circumferential distance equal to one seventh radial segment arc, all of said ramp and notch interlocking means being aligned in the directions of rotation of the lids and co-operating when the lids are rotated by hand for controlling the rotational direction of the lids with respect to each other and the base, and providing dosage interval click stops whereby all compartments may be covered and radial sector storage compartments and arcuate segment storage compartments selectively and successively uncovered and dosage dispensed from the compartments through lid openings, said lower interlocking means allowing said lower lid to be rotated in one direction only with respect to said container and said upper interlocking means allowing said upper lid and said lower lid to be rotated together in said one direction and said upper lid to be rotated by itself only, in the opposite direction to close all compartments or selectively open compartments whereby rotation of both said lids in said one direction enables said radial sector compartment access opening of said lower lid to be located above and aligned with one selected radial sector storage compartment of said container and rotation of said upper lid in said other direction enables one of said arcuate access openings to be located above and aligned with one of said correspondingly shaped arcuate storage compartments of said container.

6. An oral, solid dosage form, pharmaceutical dispenser comprising: a flat, circular container with a transparent walled base having a plurality of arcuate storage compartments arranged within main radial sector storage compartments formed by radial walls and a peripheral wall with a stepped exterior surface, all of the arcuate circular segment, storage compartments being formed by subdividing the radial walls by annular walls; a lower circular lid and an upper circular lid superposed over the lower lid, each lid having a central hole, the lower lid having a peripheral skirt and a single radial sector storage compartment access opening corresponding in shape, area and dimension to each main radial sector storage compartment, the upper lid having four openings therein, each opening corresponding in area, shape and dimension to a respective arcuate segment compartment which it overlies and being spaced radially successively in a series of immediately adjacent openings, each at a distance equal to the radial width of each adjoining arcuate sector compartment and spaced angularly, successively at a distance corresponding to the angular length of the said respective sector compartment which said opening overlies each said arcuate segment compartment being sequentially uncovered by four successively angular movements of the said upper lid in the same angular direction, a resilient bifurcated pivot pin detachably passable through the central hole of both lids and accessible to finger manipulation from outside the lids and the container for rotatably and resiliently clamping the lids onto the container and for removal of the lids from the container to recharge the container with dosages; lower interlocking means comprising a single fixed ramped tooth projecting upwardly from the stepped exterior surface of the peripheral wall of the container and fixed with respect thereto for interlocking successively with seven complementary shaped means comprising ratchet indentations on the lower edge of the peripheral skirt of, and fixed with respect to the lower lid and rotating only when the said lower lid is rotated, upper interlocking means comprising a single fixed ramped tooth projecting upwardly from the upper surface of, and fixed with respect to, the lower lid adjacent the perimeter thereof interlocking with complementary shaped means of the lower surface, and fixed with respect to the upper lid and comprising six equidistantly spaced indentations of complementary shape to the single ramped tooth on the lower lid and rotating with the upper lid and at a circumferential distance equal to one seventh radial segment arc, all of said ramp and notch interlocking means being aligned in the direction of rotation of the lids and co-operating when the lids are rotated by hand for controlling the rotational direction of the lids with respect to each other and the base and providing dosage interval click stops whereby all compartments may be covered and radial sector storage compartments and arcuate segment storage compartments selectively and successively uncovered and dosage dispensed from the compartments through lid openings, said lower interlocking means allowing said lower lid to be rotated in one direction only with respect to said container and said upper interlocking means allowing said upper lid and said lower lid to be rotated together in said one direction and said upper lid to be rotated by itself only in the opposite direction to close all compartments or selectively open compartments whereby rotation of both said lids in said one direction enables said radial sector compartment access opening of said lower lid to be located above and aligned with one selected radial sector storage compartment of said container and rotation of said upper lid in said other direction enables one of said arcuate access openings to be located above and aligned with one of said correspondingly shaped arcuate storage compartments of said container.

* * * * *